US005852919A

United States Patent [19]

Matsuda et al.

[11] Patent Number: 5,852,919

[45] Date of Patent: Dec. 29, 1998

[54] PACKAGING MACHINE

[75] Inventors: Hiroyuki Matsuda; Kiyomi Yoshida; Michio Ueda, all of Tokushima, Japan

[73] Assignee: Shikoku Kakoki Co., Ltd., Tokushima, Japan

[21] Appl. No.: 892,063

[22] Filed: Jul. 14, 1997

[30] Foreign Application Priority Data

Jul. 15, 1996 [JP] Japan ..... 8-185202

[51] Int. Cl.[6] ..... B65B 9/20; B65B 61/24

[52] U.S. Cl. ..... 53/551; 53/202; 53/552

[58] Field of Search ..... 53/451, 551, 552, 53/202, 113, 554, 527, 439, 449, 170

[56] References Cited

U.S. PATENT DOCUMENTS

| | | | |
|---|---|---|---|
| 3,479,795 | 11/1969 | Martin | 53/202 X |
| 3,857,223 | 12/1974 | Dominici | 53/552 X |
| 4,117,649 | 10/1978 | Egli | 53/552 X |
| 4,215,520 | 8/1980 | Heinzer et al. | 53/552 X |
| 4,269,016 | 5/1981 | Kopp et al. | 53/202 X |
| 4,580,392 | 4/1986 | Lagerstedt et al. | 53/552 X |
| 4,784,697 | 11/1988 | Bordini | 53/551 X |
| 5,031,380 | 7/1991 | Ueda | 53/552 X |

FOREIGN PATENT DOCUMENTS

| | | |
|---|---|---|
| 0378880 A | 7/1990 | European Pat. Off. . |
| 271035 A | 12/1977 | Germany . |
| 3116991 A | 11/1982 | Germany . |

*Primary Examiner*—Horace M. Culver

*Attorney, Agent, or Firm*—Armstrong, Westerman, Hattori, McLeland & Naughton

[57] ABSTRACT

A packaging machine comprising an incomplete container forming device for forming a web into a tube, filling contents into the tube, thereafter transporting the tube by a length corresponding to one container at a time, sealing and cutting the tube transversely of the tube every time the tube is transported to obtain flat tubular incomplete containers, and discharging the containers as arranged in a row; a pair of container conveyors arranged at a lower level than the discharging position of the device, horizontally spaced from the discharging position by a specified distance and having respective transport paths spaced from each other by a predetermined distance; a complete container forming device for making the incomplete containers into complete rectangular parallelepipedal containers during transport on the conveyors; and a transfer device for receiving the row of incomplete containers as discharged from the incomplete container forming device, dividing the row into two rows and delivering the two rows alternately to the respective container conveyors.

5 Claims, 14 Drawing Sheets

15
171
30
173
174
12
25
204
202
203
185
14
61
201
199
195
172
198
196
184
64
31
65
33
34
26
194
29
35
IV
197
63
141
143
193
X
183
121
122
148
166
VIII
101
192
28
32
111
VII
27
182
59
58
223
214
257
18
16
221
258
181
225
226
213
254
212
255
256
253
191
215
62
242
245
251
259
C
17
211
11

PACKAGING MACHINE

BACKGROUND OF THE INVENTION

The present Invention relates to packaging machines for producing sealed rectangular parallelepipedal containers filled with contents from a web of packaging material.

The conventional packaging machines of the type mentioned include those comprising an incomplete container forming device for forming a web into a tube, filling contents into the tube, thereafter transporting the tube by a length corresponding to one container at a time, sealing and cutting the tube transversely of the tube every time the tube is transported to obtain flat tubular incomplete containers, and discharging the containers, a slanting chute having an upper end connected to the device at the discharging position, a container conveyor having a transport path the starting and of which is connected to the lower end of the slanting chute, and a complete container forming device for making the incomplete containers into rectangular parallelepipedal complete containers during transport on the conveyor.

The complete container forming device is lower than the incomplete container forming device in treating capacity because the former executes a more complex process which requires a longer period of time. The inferior capacity of the device therefore imposes limitations on the increase in the speed of packaging operation of the overall machine to improve the treating capacity thereof.

While the chute in used for transferring containers from the incomplete container forming device to the conveyor, the containers sliding down the chute are likely to deform or become damaged when received by the conveyor. If containers are damaged, the complete container forming device will encounter difficulty in completing the containers, while the products obtained will be of impaired commercial value.

SUMMARY OF THE INVENTION

An object at the present invention is to overcome the above problems and to provide a packaging machine which is adapted to perform a packaging operation at a higher speed and given an increased treating capacity.

The present invention provides a packaging machine comprising an incomplete container forming device for forming web into a tube, filling contents into the tube, thereafter transporting the tube by a length corresponding to one container at a time, sealing and cutting the tube transversely of the tube every time the tube is transported to obtain flat tubular incomplete containers, and discharging the containers as arranged in a row; a pair of container conveyors arranged at a lower level than the discharging position of the device, horizontally spaced from the discharging position by a specified distance and having respective transport paths spaced from each other by a predetermined distance; a complete container forming device for making the incomplete containers into complete rectangular parallelepipedal containers during transport on the conveyors; and a transfer device for receiving the row of incomplete containers as discharged from the incomplete container forming device, dividing the row into two rows and delivering the two rows alternately to the respective container conveyors.

With the packaging machine embodying the invention, the containers discharged from the incomplete container forming device in a row can be processed in two rows by the complete container forming device. This ensures a packing operation of increased speed and results in an improved treating capacity.

Preferably, the transfer device comprises a slanting chute generally U-shaped in cross section and extending from the discharging position toward a space between starting ends of the transport paths of the conveyors, a dividing plate disposed between the starting ends of the transport paths and continuous with a lower edge of bottom wall of the chute for receiving each container to restrain the container from descending while rendering the container free to move horizontally, a container receiving member so disposed as to move upward and downward along the chute and to advance into the chute when moving downward, and a container pushing member reciprocatingly movable on the dividing plate in directions orthogonal to a path of upward and downward movement of the container receiving member.

Since the container discharged from the incomplete container forming device is received by the container receiving member in the vicinity of the upper end of the chute, the distance the container falls off the device can be shortened, consequently diminishing the impact to be produced when the container is received by the receiving member and reducing the damage to the containers.

The containers received by the dividing plate are transported by the pushing member to the two conveyors alternately and can therefore be divided into two rows reliably.

Preferably, the container receiving member is moved downward at a speed lower than the velocity at which the container falls down the chute under gravity.

The container as guided along the chute and received by the receiving member is transported in this state to the dividing plate. This mitigates the impact to be produced when the container is received by the dividing plate, also obviating the damage to be caused when the containers is allowed to fall a greater distance.

Preferably, the container receiving member is attached to an endless chain having a lower path of travel positioned within the chute so that the receiving member is advanced into the chute from the chain on the lower path.

The movement of the chain automatically causes the receiving member to receive the container and release the container, with the result that the container can be received and released reliably.

Further preferably, the dividing plate is formed with a slit extending in parallel to a path of reciprocating movement of the container pushing member, end a guide rail extending in parallel to the slit and an endless chain are arranged at one side of the dividing plate opposite to the path of reciprocating movement, the endless chain having a reciprocatingly moving straight path parallel to the guide rail, a slider being fitted to the guide rail and formed with a guide groove extending in a direction orthogonal to the guide rail, a pushing pin being attached to the chain and fitted in the guide rail, the container pushing member being attached to the slider by a connecting member inserted through the slit.

Since the container pushing member can be reciprocatingly moved merely by driving the chain, the drive mechanism used is simple.

Furthermore, the container can be pushed by the pushing member and released therefrom automatically.

DESCRIPTION OF THE PREFERRED EMBODIMENT

An embodiment of the invention will be described below with reference to the drawings.

In the following description, the terms "front" and "rear" refer respectively to the right-hand side and left-hand side of FIG. 1, the term "left" refers to one side of the plane of FIG. 1 closer to the viewer, and the term "right" to the other side thereof. (The terms "right" and "left" are used as such for the machine as it is seen from the front rearward.)

The packaging machine of the present invention is adapted to produce two kinds of, i.e., high and low, rectangular parallelepipedal sealed containers filled with contents, from a rolled-up web of paper-base laminate having a polyethylene layer over the inner and outer surfaces thereof. These containers are identical in cress sectional area but different in height and therefore different in capacity.

Figure 1:
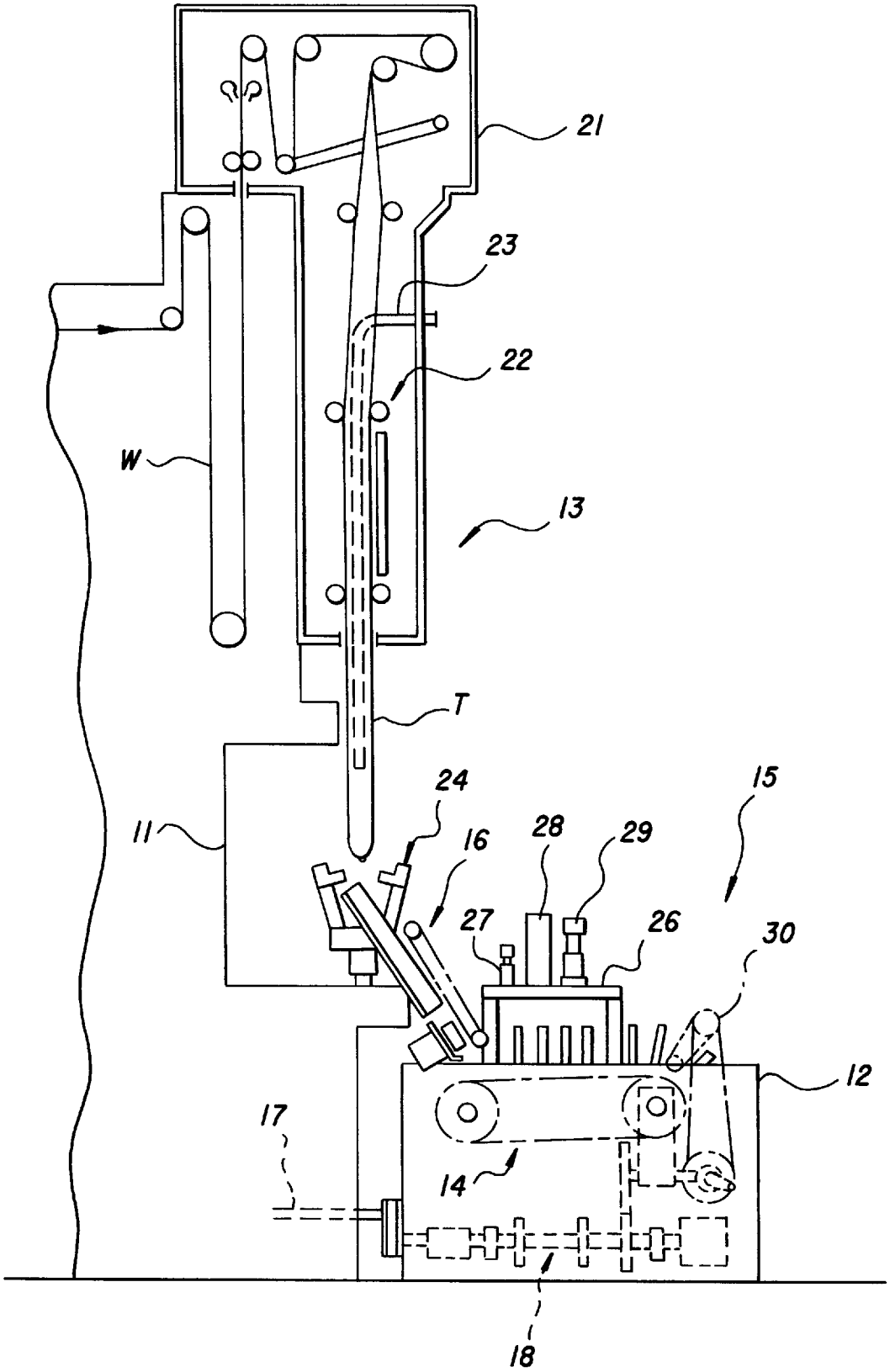
FIG. 1 is a side elevation showing a packaging machine embodying the invention.
Figure 2:
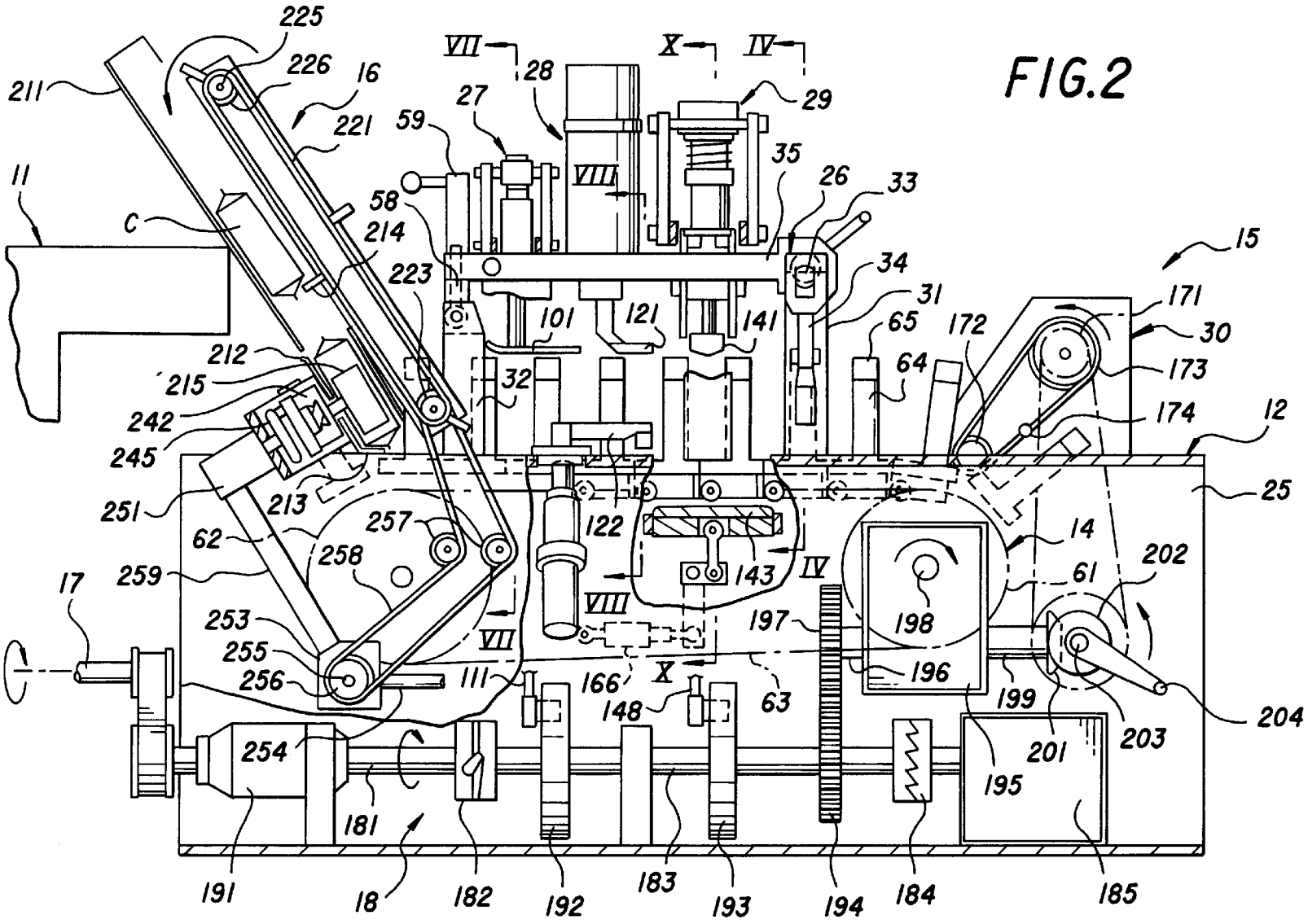
FIG. 2 is a side elevation showing a conveyor, second device group, drive mechanism and transfer device of the packaging machine.

With reference to FIGS. 1 and 2 showing the packaging machine, the machine comprises a main frame 11, a pair of right and left front frames 12, a first device group 13 mounted on the main frame 11 for forming the web W into flat tubular incomplete containers C and discharging the containers as arranged in a row, a pair of right and left container conveyors 14 mounted on the respective front frames 12 and each having a path of transport which extends forward from a position to the front of and obliquely downward from the discharging position of the group 13, a pair of right and left second device groups 15 arranged along the paths of transport of the respective conveyors 14 for forming incomplete containers C into rectangular parallelepipedal complete containers C while being transported on he conveyor 14, and a transfer device 16 provided between the main frame 11 and the front frame 12 for receiving incomplete containers C as discharged in a row from the first device group 13, guiding the row dividedly into two rows and delivering the containers to the two conveyors 14 alternately.

The right and left front frames 12 are of the same constructions The right and left conveyors 14, as well as the second device groups 15, are also identical in construction, but are driven with a phase difference of 180 deg per cycle of 360 deg.

Housed in the main frame 11 is a main shaft 17 which is driven by an unillustrated drive source. The main shaft 17 drives the first device group 13. Housed in the front frame 12 is a drive mechanism 18 for driving the conveyor 14, second device group 15 and transfer device 16. The main shaft 17 projects from the main frame 11 and is coupled to the drive mechanism 18 for power transmission.

The first device group 13 includes a tube forming device 22 disposed within an aseptic chamber 21 for forming the web W into a tube T, a filling pipe 23 extending into the chamber 21 from outside for filling the tube T with contents, and an incomplete container forming device 24 disposed outside the chamber 21 for transporting the tube T filled with contents by a length corresponding to one container at a time, and sealing and cutting the tube transversely thereof.

Each front frame 12 has right and left box-shaped side frames 25. A frame 26 for adjusting the height of the second device group is mounted on the two side frames 25 to bridge the space therebetween (FIGS. 3 and 4).

Each second device group 15 comprises an ear folding device 27 for folding upper and lower end portions of the incomplete container C flat while causing a pair of upper or lower triangular ears to project from each folded portion, a device 28 for heating the triangular ears, and an ear bonding device 29 for bonding the ears to the side wall of the container under pressure. These ear folding device 27, heating device 28 and bonding device 29 are successively arranged from front rearward. A container discharge device 30 is disposed at the terminal end of the container transport path of the conveyor 14.

Figure 3:
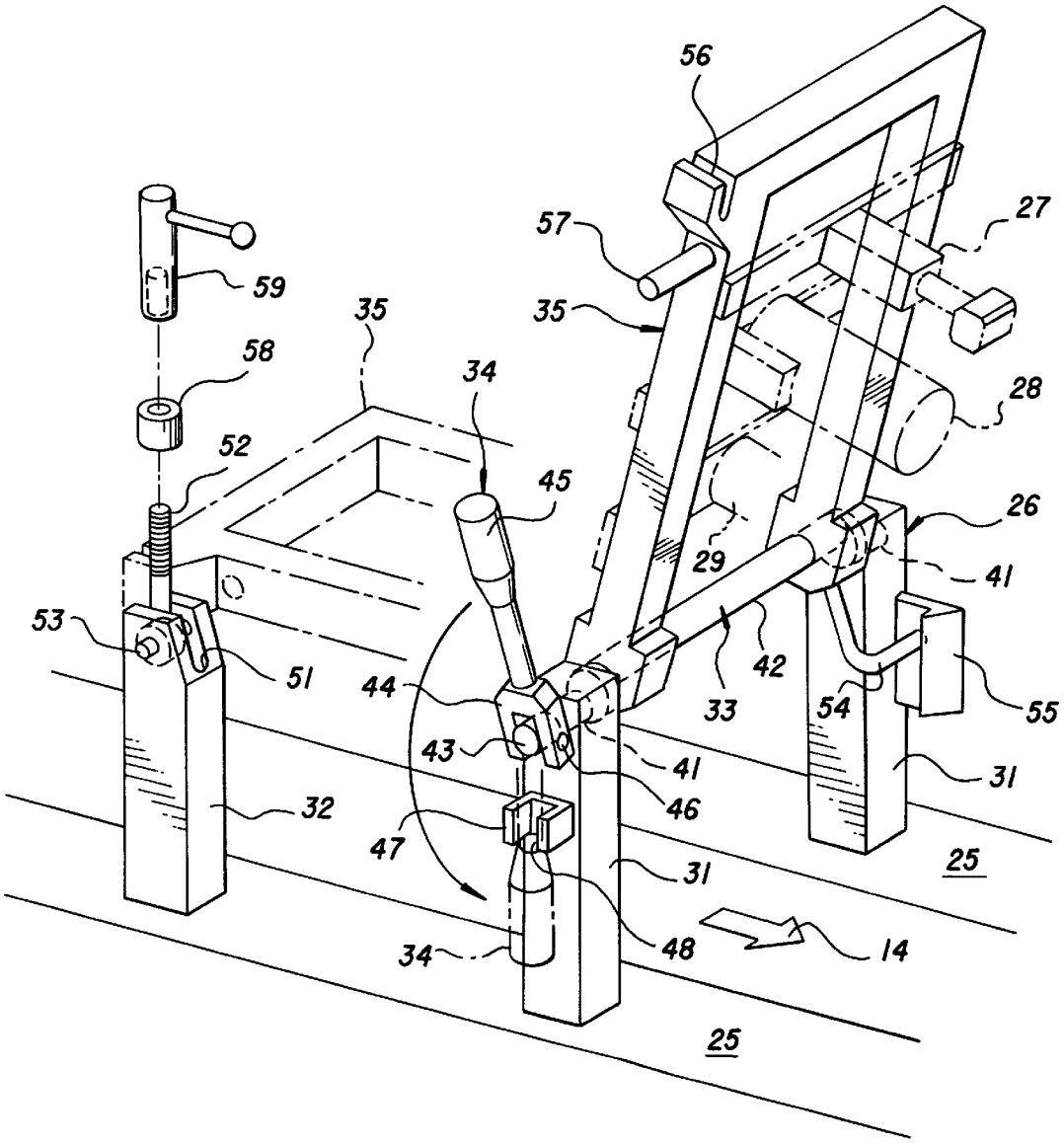
FIG. 3 is a perspective view showing a frame for adjusting the level of device groups of the machine.
Figure 4:
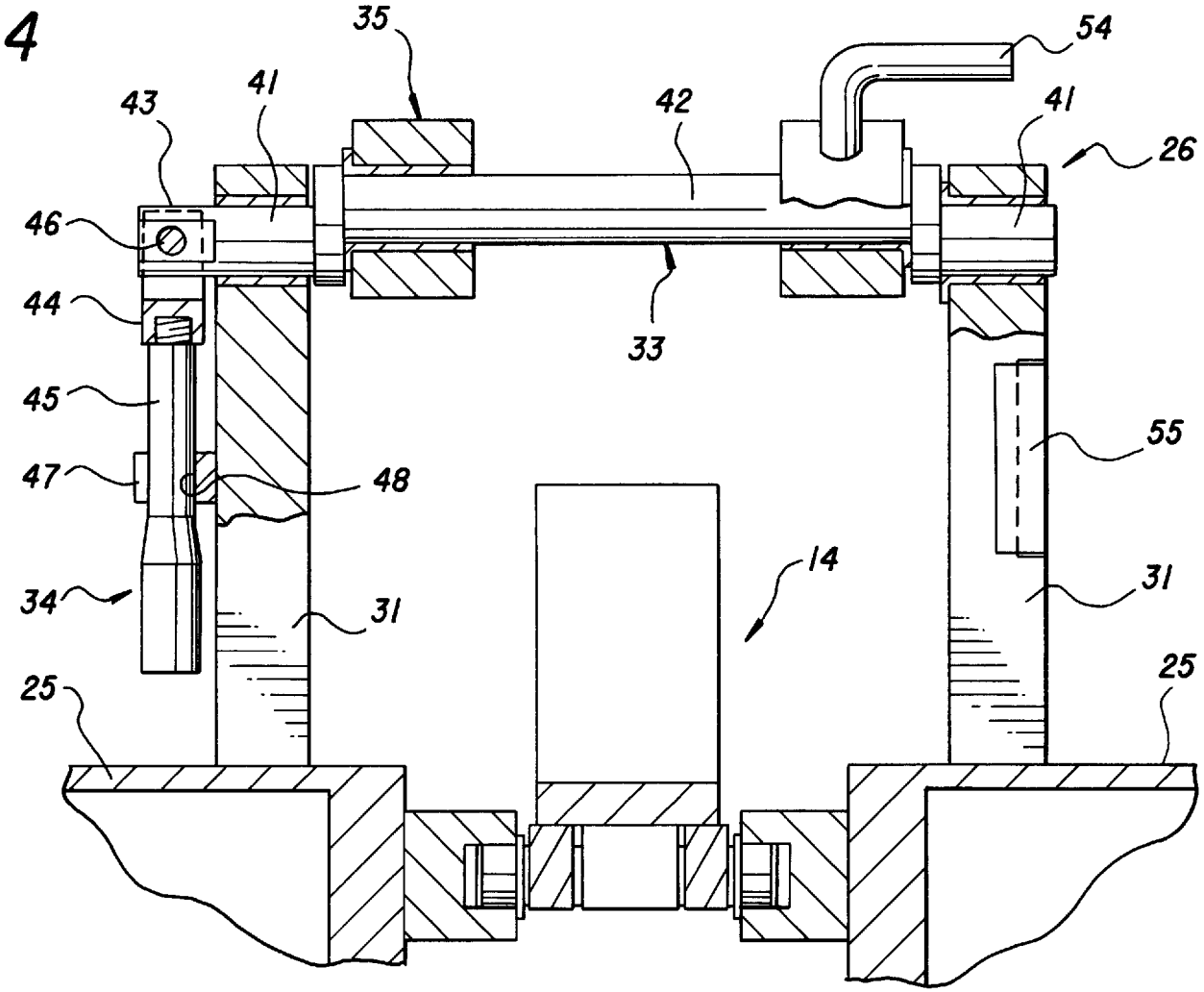
FIG. 4 is a view in vertical cross section taken along the line IV—IV in FIG. 2 and showing the frame.

As shown in detail in FIGS. 3 and 4, the height adjusting frame 26 comprises a pair of front posts 31 provided upright on the respective side frames 25, a single rear post 32 upstanding from the left side frame 25 only, a horizontal pivot 33 supported by and extending between the upper ends of the front posts 31, a manual handle 34 connected to the left end of the pivot 33, and a U-shaped mount frame 35 having an open front side, front ends supported by the pivot 33 and a rear end supported by the rear post 32 and provided thereon with the second device group 15 as attached by suitable mount members.

With reference to FIG. 4, the pivot 33, comprising a crankshaft, has journals 41 and a crankpin 42. The crankpin 42 has a radius of revolution which is exactly one-half of the difference between the complete high container and the complete low container. The journal 41 extends through an upper end portion of each front post 31. The journal 41 at left projects leftward beyond the front post 31 end is provided at the projecting portion with an operating portion 43 having two parallel faces. With the crankpin 42 up or down, the two parallel faces of the operating portion 43 are vertical.

The handle 34 comprises a U-shaped mount 44 holding the parallel faces of the operating portion 43, and a grip 45 in the form of a straight rod and extending in a direction opposite to an open end of the mount 44. A connecting pin 46 extends through the operating portion 43 and the mount 44 and is orthogonal to the axis of the journal 41, to the two parallel faces and further to the axis of the grip 45.

A U-shaped lock member 47 is secured to the left side face of the left front post 31 and positioned immediately below the operating portion 43. The look member 47 has an engaging groove 48 facing leftward and left open at its upper and lower ends.

The rear post 32 is formed In its upper end with an upward slit 51 let open at the front and rear ends. The slit 51 has fitted therein the head of an eyebolt 52. An engaging pin 53 extends through the slitted post upper end and through the head of the eyebolt 52.

The crankpin 42 extends through the front ends of the device mount frame 35. An L-shaped stopper arm 54 is fixed to the front right corner of the frame 35. As seen in FIG. 3, a hook 55 for releasably engaging the stopper arm 54 with the mount frame 35 in an upstanding position is attached to the right front post 31 in a forwardly projecting form. The hook 55 is biased by unillustrated resilient means so as to be pivotally movable horizontally. The rear left corner of the mount frame 35 is formed with a cutout 56 opened rearward for inserting the shank of the eyebolt 52 thereinto. The frame 35 has a handle bar 57 projecting leftward and positioned to the front of and adjacent to the cutout 56.

FIG. 4 shows the mount frame 35 in condition for the production of the higher of the two kinds of, i.e., high and low, complete containers. The grip 45 of the handle 34 is in engagement with the lock member 47 with the crankpin 42 up. The pivot 33 is immovable in this state. A tubular spacer 58 fitting around the eyebolt 52 is interposed between the upper end face of the rear post 32 and the lower surface of rear left corner of the frame 35. The height of the spacer 58 is equal to twice the radius of revolution of the crankpin 42, i.e., to the difference between the high and row complete containers in height. The screw portion of the eyebolt 52 is projected upward from the cutout 56 and has screwed thereon a nut 59 provided with a fastening handle.

A size changing procedure will be described below for changing over the mount frame 35 from the condition for producing high complete containers to the condition for producing low complete containers. The nut 59 is loosened, and the eyebolt 52 is turned rearward with the spacer 58 thereon, moving the shank of the eyebolt 52 out of the cutout 56. The nut 59 need not be removed from the bolt 52 at this time.

The grip 45 of the handle 34 is disengaged from the lock member 47, whereupon the pivot 33 is rotated through 180 deg by the handle 34. The handle 34 which is directed upward by this movement is pivotally moved downward to bring the grip 45 into engagement with the lock member 47. Consequently, the level of the mount frame 35 is lowered by an amount corresponding to twice the radius of revolution of the crankpin 42, i.e., to the difference between the high and low complete containers in height. On the other hand, the rear left corner of the mount frame 35 is placed directly on the upper end face of the rear post 32, and the nut 59 is tightened up with the spacer 58 positioned on the upper surface of the corner. This lowers the level of the entire frame 35 by the amount corresponding to the difference in height between the high and low complete containers, whereby the size changing procedure is completed.

Figure 5:
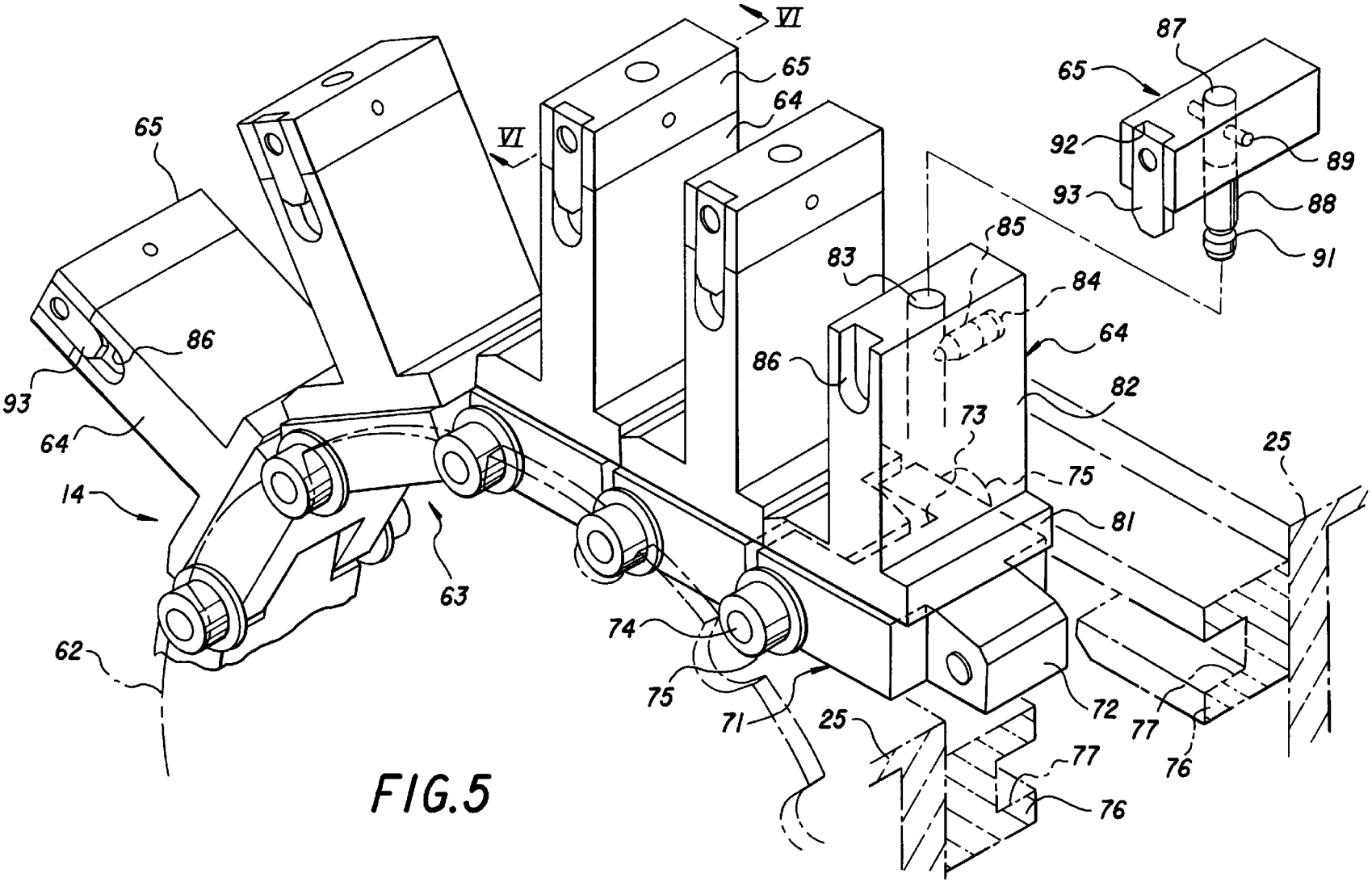
FIG. 5 is a perspective view showing the machine in the vicinity of the starting end of transport path of the conveyor.

As shown chiefly in FIGS. 2 and 5, the container conveyor 14 comprises a front drive sprocket 61, a rear driven sprocket 62, an endless block chain 63 reeved around these sprockets 61, 62, a multiplicity of holders 64 attached to the chain 63 and arranged in succession so as to be in contact with one another, and attachments 65 equal in number to the number of holders 64 and removably mounted on the respective holders 64.

The chain 63 has a multiplicity of transport blocks 71. Each of the blocks 71 is formed with a forward projection 72 and rearwardly opened recess 73. The projection 72 of each block 71 is fitted in the recess 73 of the preceding block 71, and a connecting pin 74 extends through the fitting projection 72 and the recessed portion 73. The pin 74 has opposite ends projecting sideways from the block 71. A roller 75 is mounted on each projecting end of the connecting pin 74. A pair of horizontal guide rails 76 are provided on opposed surfaces of the respective guide rails 76 at a position close to their upper ends. A pair of opposed horizontal guide grooves 77 are formed in the opposed faces of the respective rails 76, and the rollers 75 are fitted into the guide grooves 77.

Each holder 74 comprises a flat bottom plate 81 secured to the upper surface of the transport block 71, and a flat side plate 82 orthogonal to the upper surface of the bottom plate 81 and integral with the plate 81. The bottom plate 81 end the side plate 82 have a width equal to the width of the high and low complete containers. The height of the side plate 82 as measured from the upper surface of the bottom plate 81 is equal to the height of the low complete container. The distance between the side plates 82 of the two adjacent holders 64 is equal to the front-to-rear thickness of the high and low complete containers.

Figure 6:
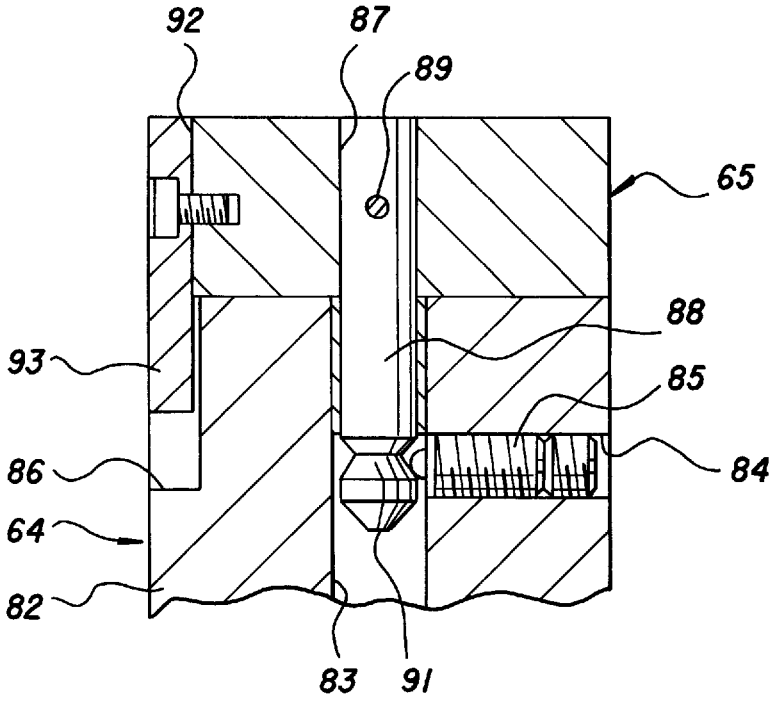
FIG. 6 is a view in vertical longitudinal section taken along the line VI—VI in FIG. 5.

With reference to FIG. 6, the side plate 82 is formed in its top with a vertical bottomed engaging bore 83 defined by a peripheral wall which is circular in cross section. The bore-defining peripheral wall is formed with a threaded bore 84 opened rightward for causing the interior of the bore 83 to communicate with the outside. A ball plunger 85 is screwed in the threaded bore 84 so as to cause the ball thereof to partially project into the engaging bore 83. A mortise 86 having a U-shaped contour and opened upward is formed in the left side face of the side plate 82.

The attachment 65 is in the form of a rectangular parallelepipedal block having a width equal to the width of the side plate 82 and a thickness equal to that of the side plate 82. The attachment 65 has a height equal to the difference in height between the high and low complete containers.

The attachment 65 has a rod bore 87 vertically extending therethrough. A vertical insert rod 88 having a circular cross section is fitted in the bore 87, with the lower half of the rod 88 projecting downward from the attachment 65. The insert rod 88 is fixed to the attachment 65 with an engaging pin 89. The rod 88 is withdrawably insertable into the engaging bore 83. The insert rod 88 is formed in its outer peripheral surface with an annular engaging recess 91. With the rod 88 inserted in the bore 83, the ball of the plunger 85 is fitted into the engaging recess 91.

A vertical retainer groove 92 opened upward and downward is formed in the left side face of the attachment 65. A retainer 93 in the form of a strip is fixedly fitted in the groove 92 and has a lower portion projecting beyond the attachment 65 and fittable into the mortise 86. The length of the depending lower portion of the retainer 93 is smaller than the length of projecting lower portion of the insert rod 88. The retainer 93 is so shaped as to snugly fit into the mortise 86 and groove 91.

The attachment 65 is removable from the holder 64 by pulling the attachment 65 upward to cause the ball of the plunger 85 to move out of the engaging recess 91 and to withdrew the insert rod 88 from the engaging bore 83. At this time, the retainer 93 is withdrawn from the mortise 86 at the same time. Conversely, the attachment 65 can be mounted on the holder 64 by inserting the lower end of the insert rod 88 into the engaging bore 83 and further inserting the entire lower half of the rod 88 into the engaging bore 83 with the retainer 93 positioned immediately above the mortise 86 to cause the ball of the plunger 85 to engage in the recess 91 and to fit the retainer 93 into the mortise 86. The attachment 65 is then unlikely to rotate or inadvertently become detached from the holder 64.

When the engaging bore 83 and the insert rod 88 are, for example, square in cross section, the attachment 65 need not be provided with retaining means for preventing rotation, so that the mortise 86 and the retainer 93 can be dispensed with.

Figure 7:
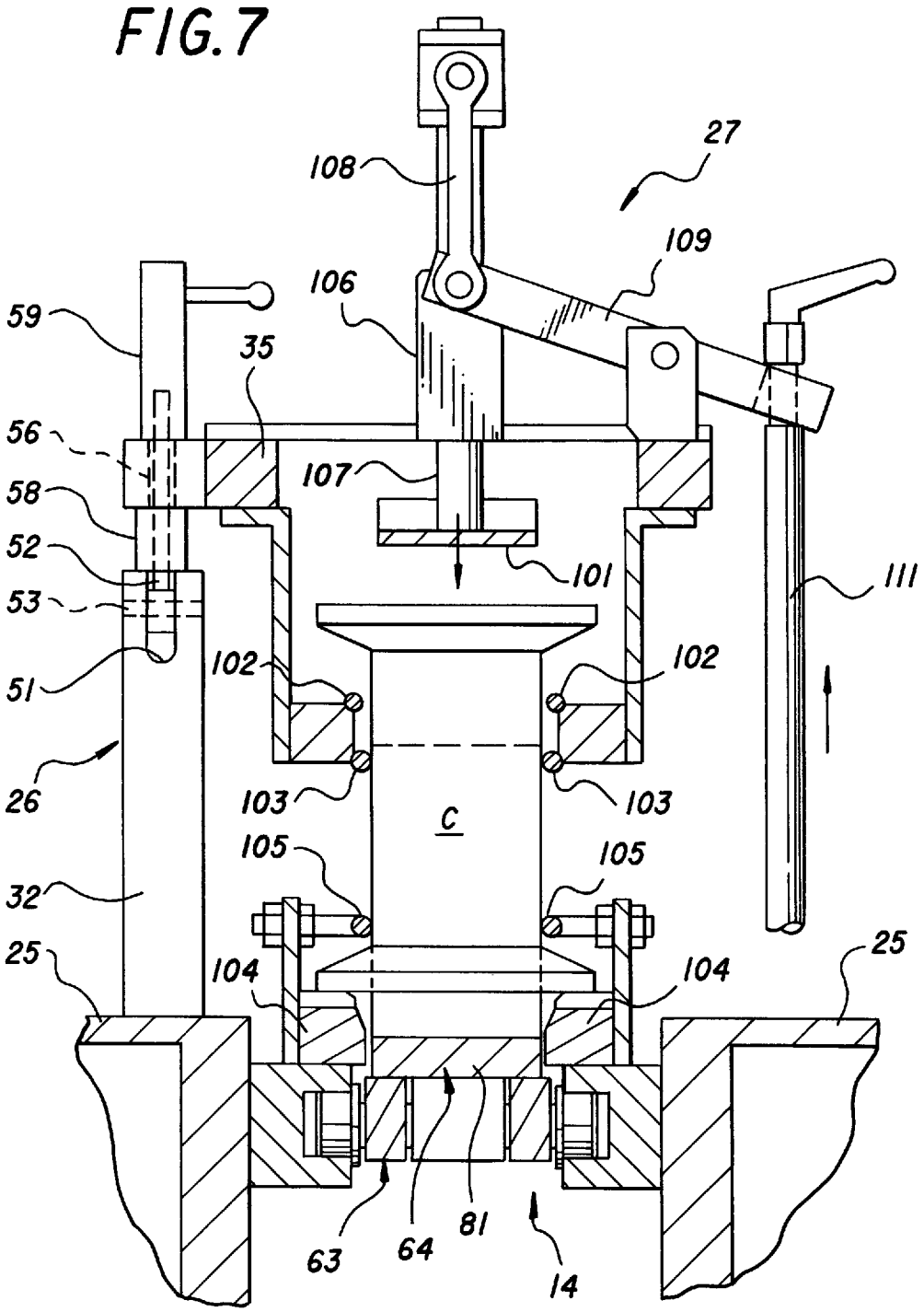
FIG. 7 is a view in vertical cross section taken along the line VII—VII in FIG. 2 and showing an ear folding device.

With reference to FIG. 7, the ear folding device 27 comprises a pressure plate 101 disposed above the container transport path, a pair of right and left upper ear folding rods 102 arranged at opposite sides of the path, a pair of upper guide rods 103 arranged immediately below the respective folding rods 102, a pair of right and left lower ear folding blocks 104 arranged at opposite sides of path of travel of the holders, and a pair of lower guide rods 105 arranged immediately above the respective blocks 104.

The pressure plate 101 is fixed to the lower end of a vertically movable rod 107 extending through a vertical guide sleeve 106 on the mount frame 35. The rod 107 has an upper end connected by a rod 108 to one and of a lever 109. The other end of the lever 109 has connected thereto the upper end of a vertical retractable rod 111 extending from the drive mechanism 18.

The incomplete container C delivered from the transfer device 16 is received by one of the holders 64 at the starting end of the container transport path. The container C received by the holder is so positioned that the portion thereof to be made into the top of a product faces downward with the bottom portion thereof up. The lower end of the incomplete container C in this state rests on the lower ear folding blocks 104 across the space therebetween, with a clearance formed between the container lower end and the holder bottom plate 81.

When the incomplete container C is transported as held by the holder 64 to the location of the ear folding device 27, the retractable rod 111 operates to lower the pressure plate 101 along with the movable rod 107. While the container C is being caused to descend by the pressure plate 101, the upper end portion of the container is folded flat by the pressure plate 101, and the lower end portion thereof is folded flat by the holder bottom plate 81. At the same time, a pair of triangular ears are folded upward by the upper ear folding rods 102 at upper folding portions to project obliquely upward, and a pair of triangular ears are similarly folded by the lower ear folding blocks 104 at lower folding portions to project likewise, The container is thereafter guide to the position of the heating device 28, with the upper ears and the lower ears held folded by the upper guide rods 103 and the lower guide rods 105, respectively.

Figure 8:
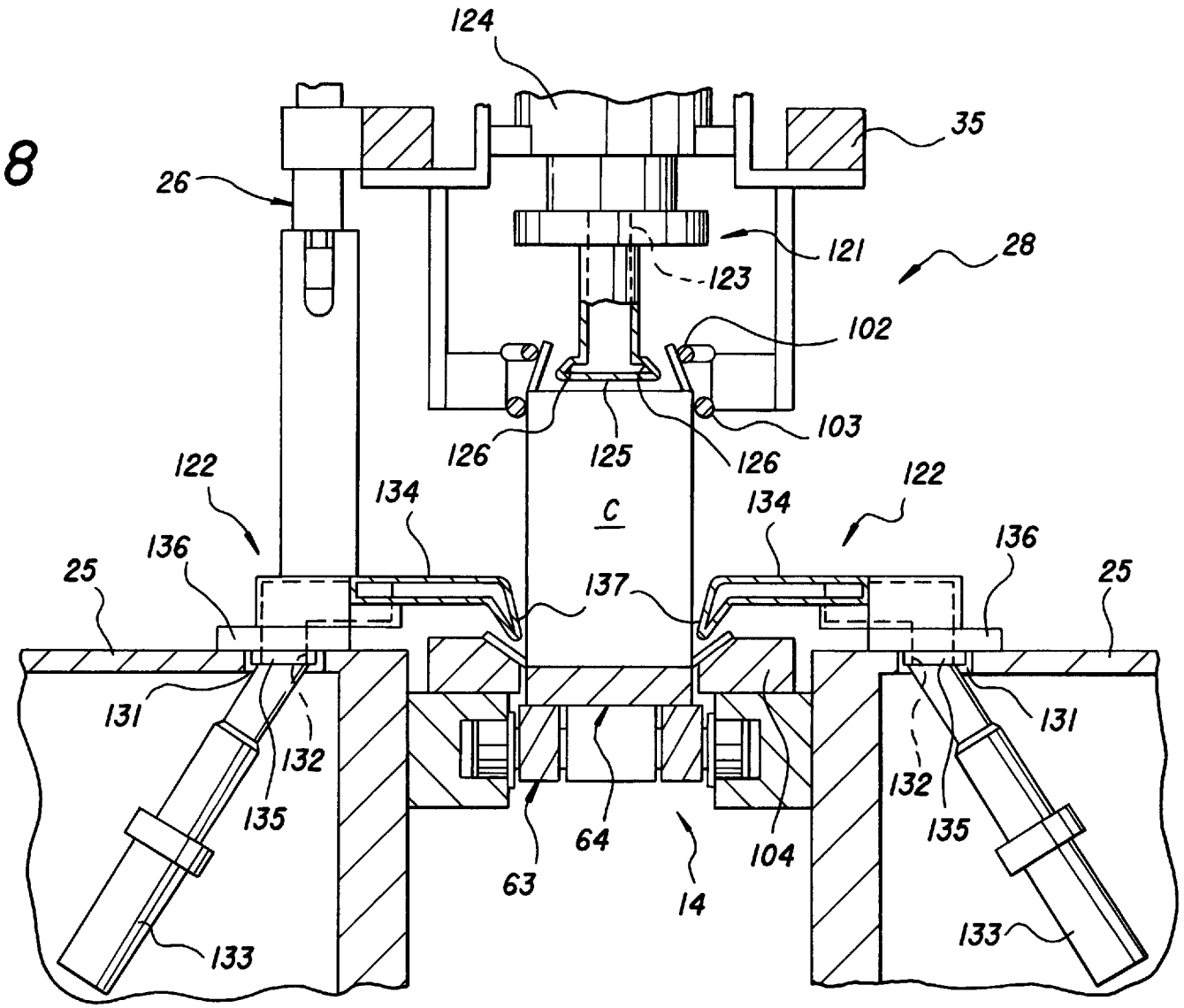
FIG. 8 is a view in vertical cross section taken along the line VIII—VIII in FIG. 2 and showing a heating device.
Figure 9:
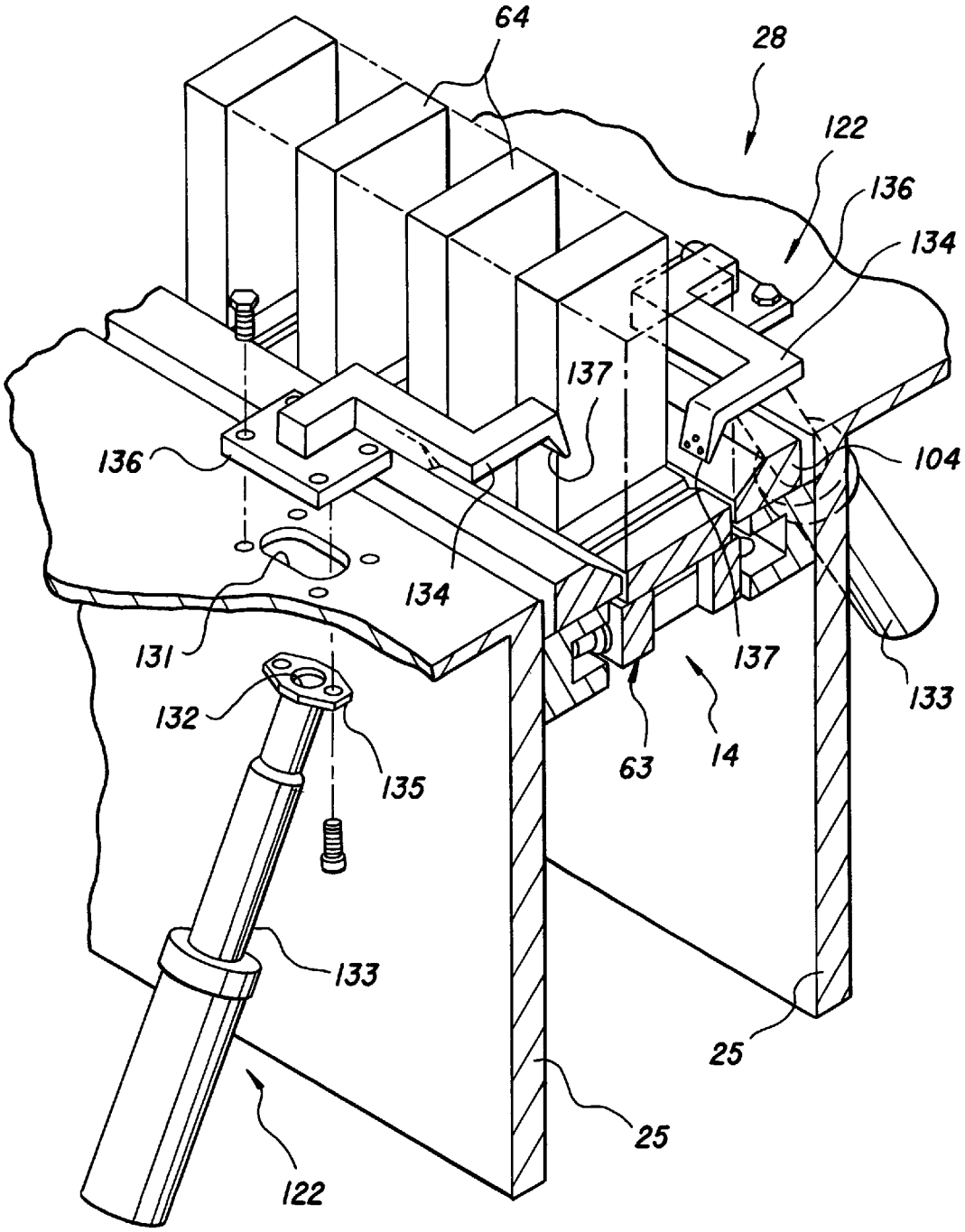
FIG. 9 is a perspective view of the heating device.

As shown in FIGS. 8 and 9, the heating device 18 comprises an upper ear heater 121 disposed above the container transport path, and a pair of lower ear heaters 122 arranged at opposite sides of the path.

The upper ear heater 121 comprises a heater main body 124 incorporating an electric circuit, attached as directed vertically downward to the mount frame 35 and having a downward hot air outlet 12, and a nozzle 125 connected to the outlet 123. The nozzle 125 comprises a tube having a rectangular cross section and generally L-shaped when seen from one side (FIG. 2). The horizontal portion of L-shaped nozzle 125 has opposite lower side edges each providing a jet orifice portion 126 which is V-shaped in cross section and opposed to the upper ear and the upper face of the container.

The lower ear heaters 122 have the same construction although oriented in different directions laterally. The left lower ear heater 122 will be described with reference to FIG. 9. The left side frame 25 has a top wall formed with a communication opening 131. The heater 122 comprises a heater main body 133 incorporating an electric circuit, extending upwardly rightward within the left side frame 25 and having an upward hot air outlet 132, and a nozzle 134 in the form of a tube having a rectangular cross section and generally L-shaped when seen from above, the nozzle 134 being connected to the hot air outlet 132. The heater main body 133 has a horizontal flange 135 around its hot air outlet 132. The nozzle 134 has a base portion formed with a horizontal flange 136, and a forward end providing a jet orifice portion 137 which is V-shaped in cross section. With the jet orifice portion 137 so positioned as to be opposed to the portion of the container between the lower ear and the side face thereof, the nozzle flange 136 is fastened to the frame top wall around the communication opening 131 so as to cover the opening along with the nozzle. The flange 135 of the heater main body 133 is inverted through the opening 131 and fastened to the lower face of the nozzle flange 136.

The heater main body 133 is accommodated in the frame 25 and therefore unlikely to be exposed to water or to come into contact with some movable member. This obviates the possible break in the wiring of the electric circuit of the heater 122.

The communication opening 131 is covered with the nozzle 134 and the flange 136 at the base portion thereof. This prevents water or like extraneous matter from ingressing into the frame 25 through the opening 131.

Figure 10:
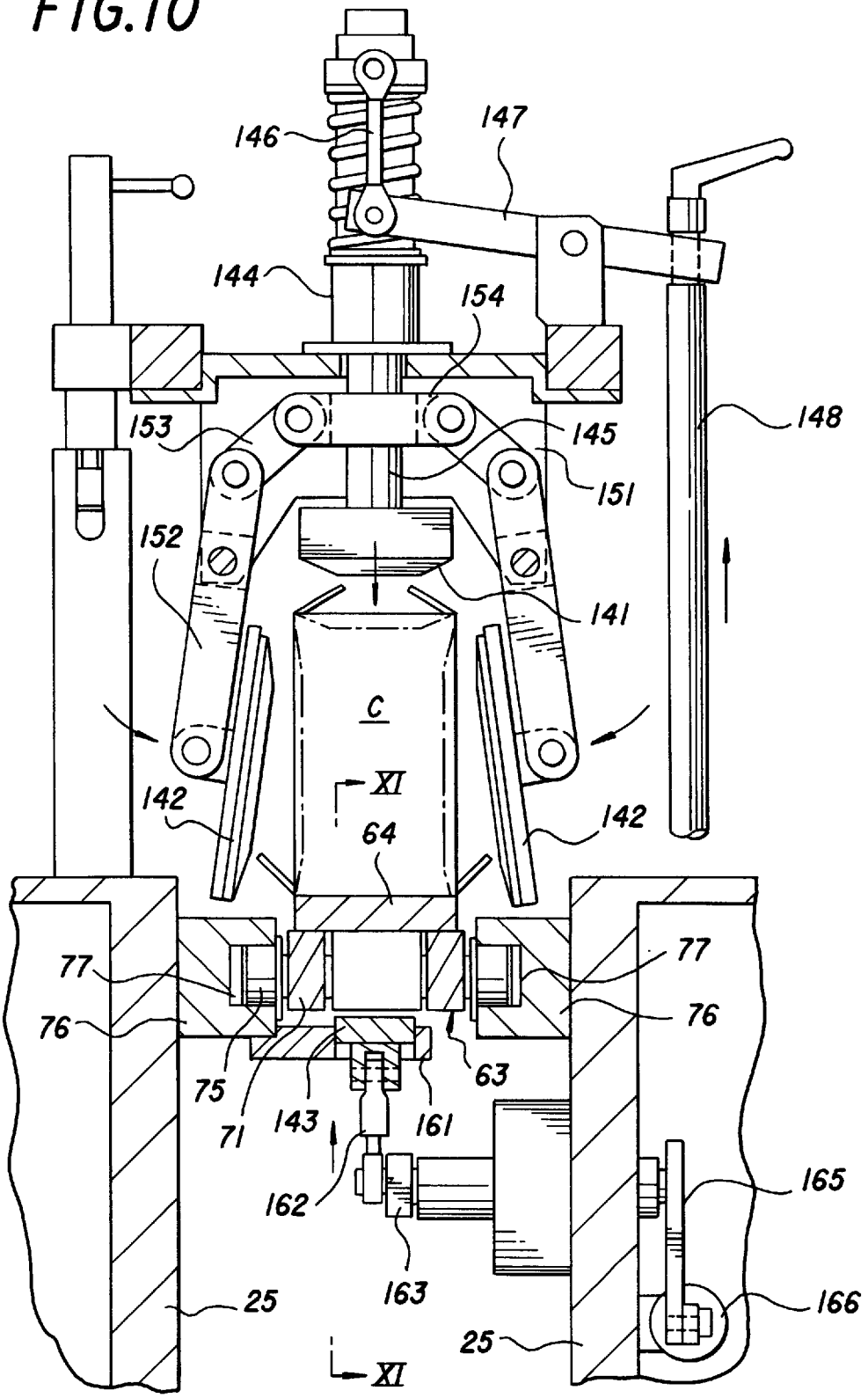
FIG. 10 is a view in vertical cross section taken along the line X—X in FIG. 2 and showing an ear bonding device.
Figure 11:
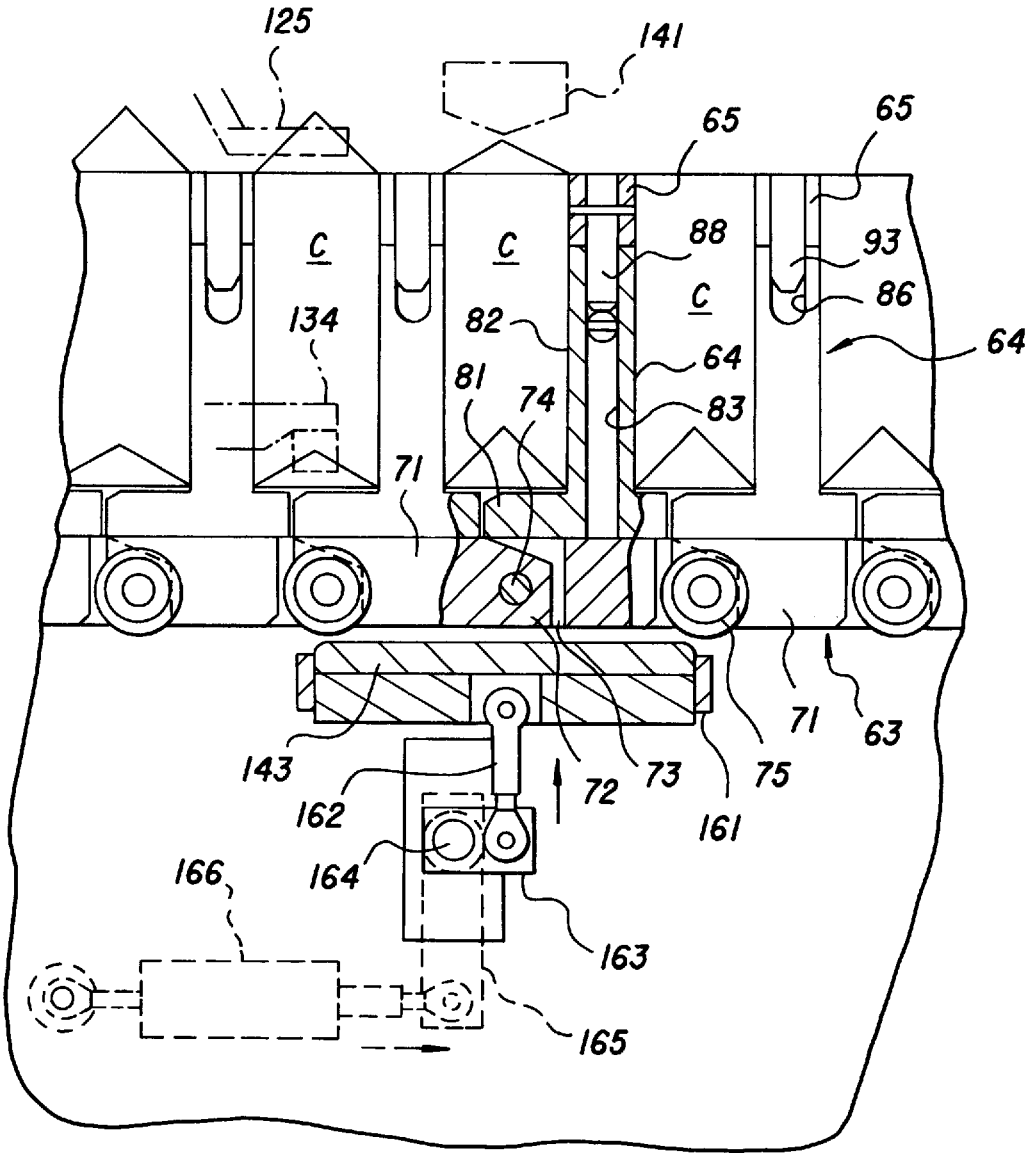
FIG. 11 is a view in vertical longitudinal section taken along the line XI—XI in FIG. 10 and showing the ear bonding device.
Figure 12:
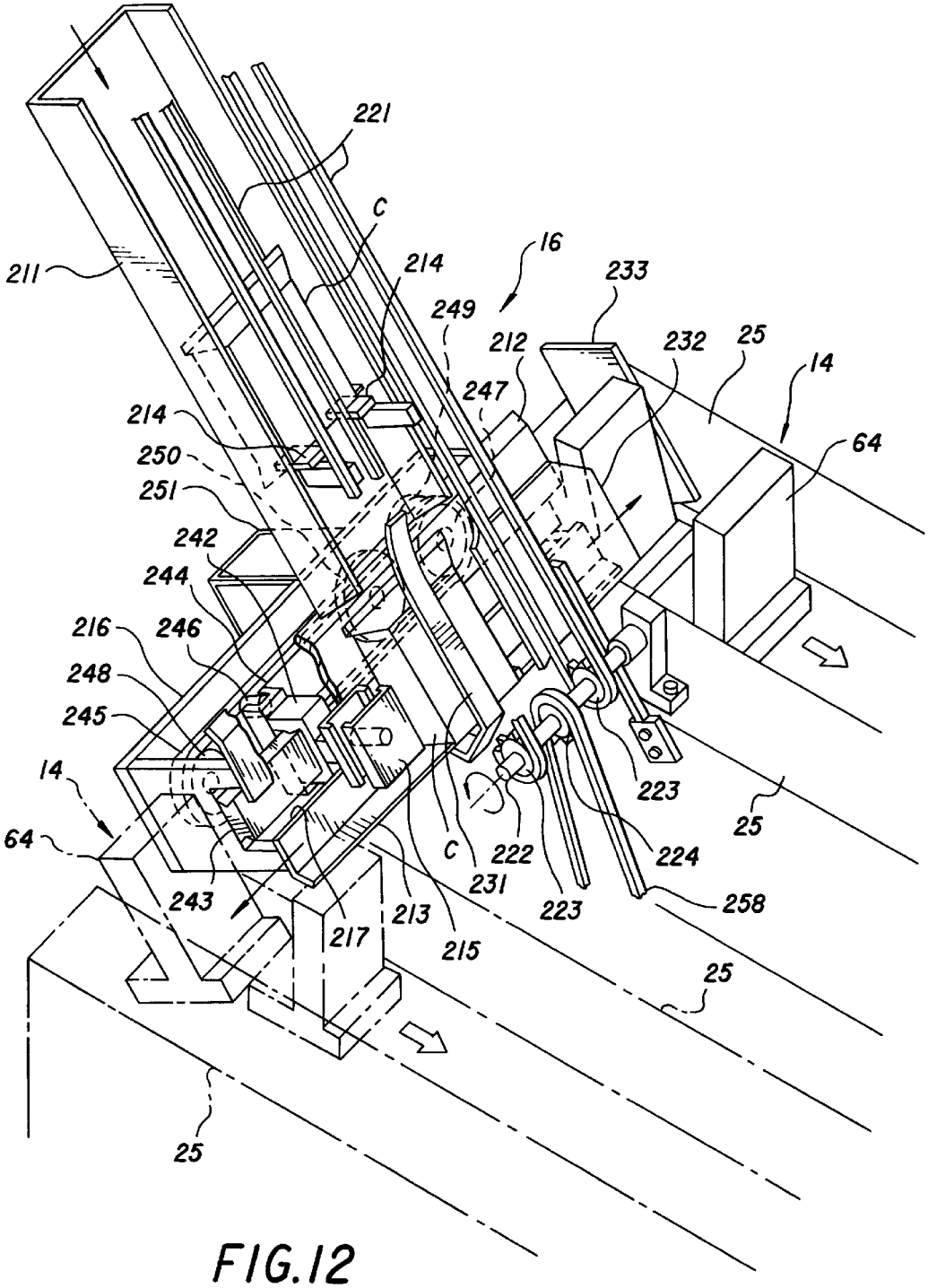
FIG. 12 is a perspective view of the transfer device of the machine.
Figure 13:
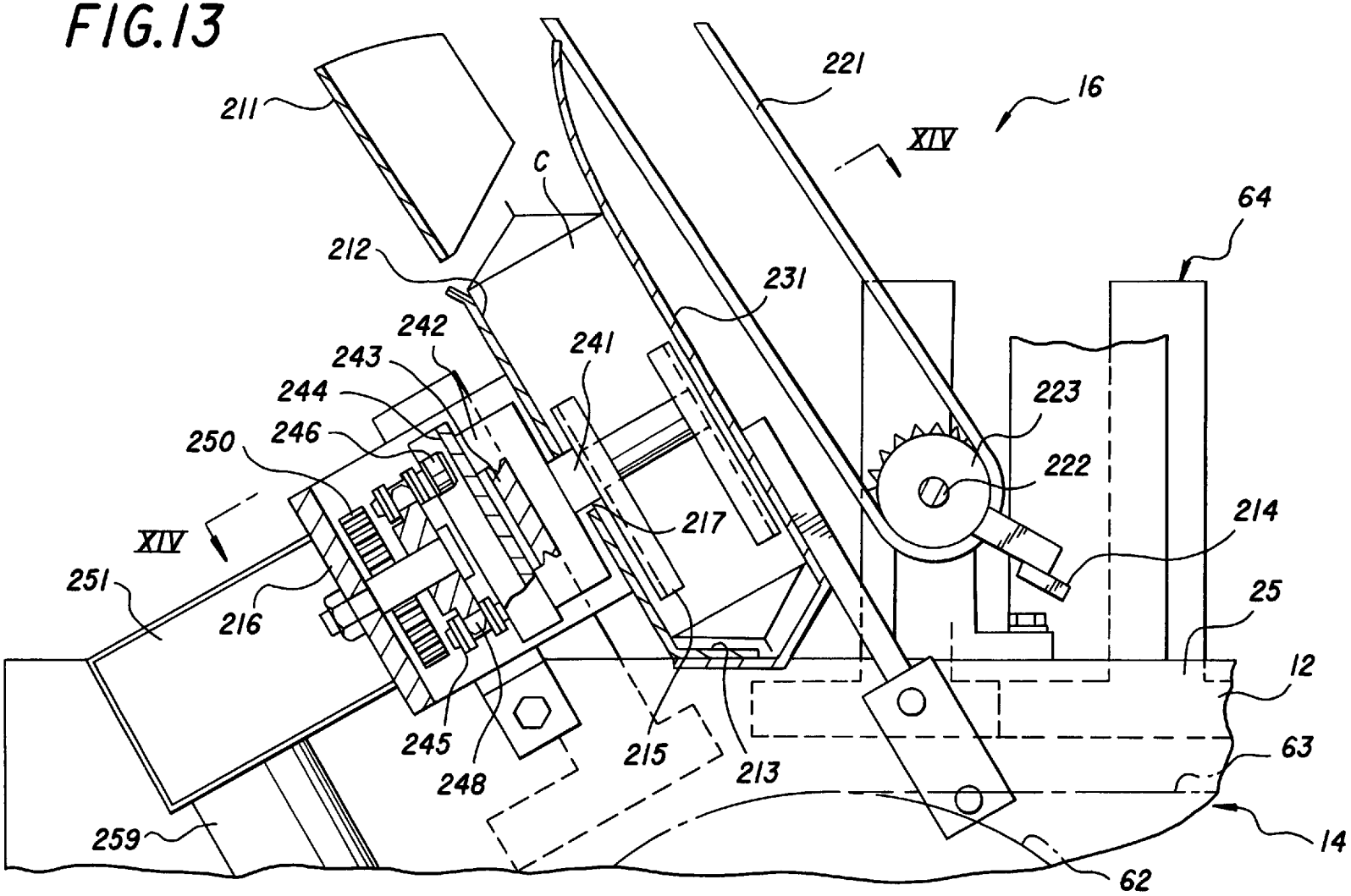
FIG. 13 is a view n vertical longitudinal section of the transfer device.
Figure 14:
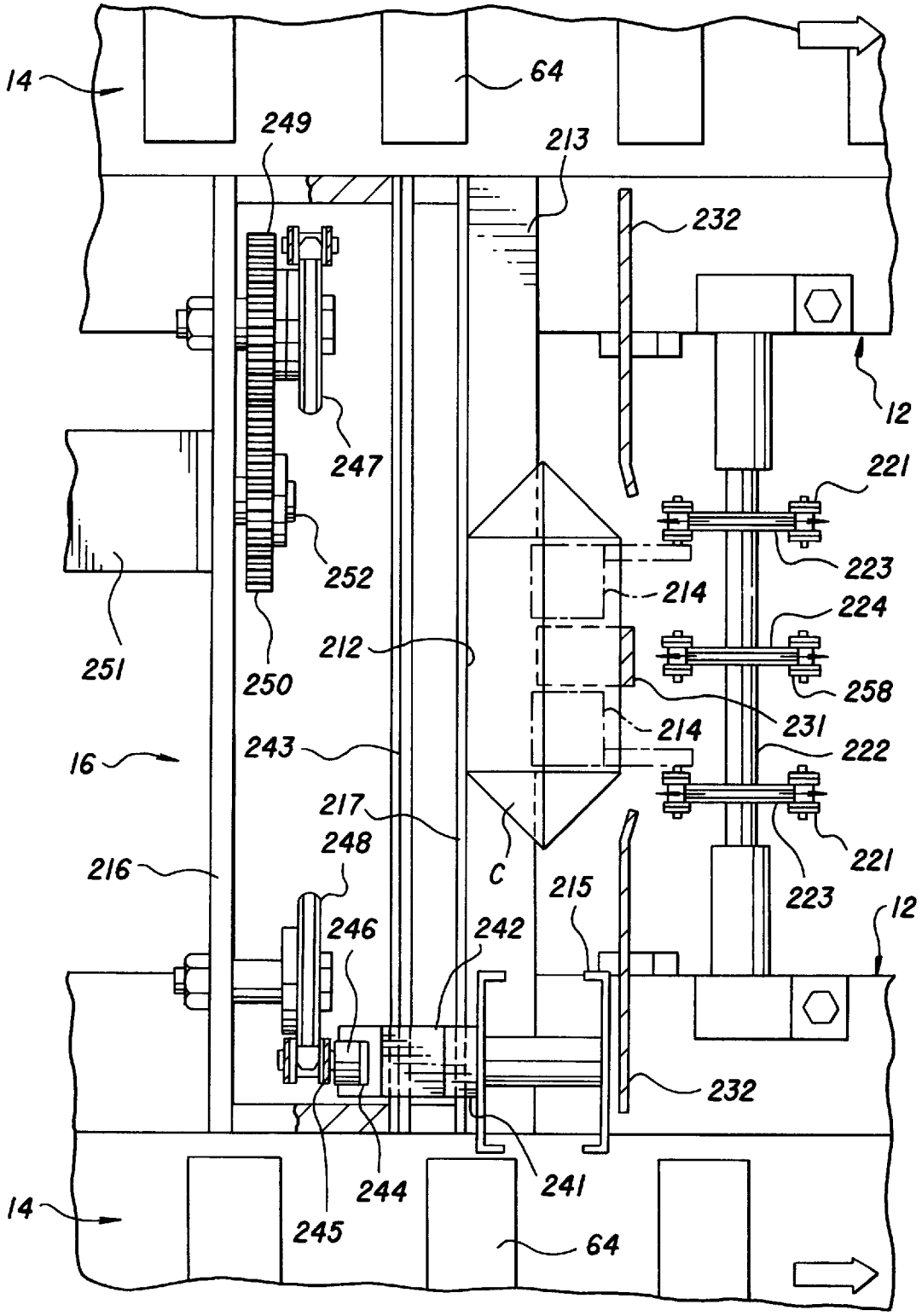
FIG. 14 is a view in horizontal section taken along the line XIV—XIV in FIG. 13.

With reference to FIGS. 10 and 11, the ear bonding device 29 comprises an upper ear pressing member 141 disposed above the container transport path, a pair of right and left lower ear pressing members 142 arranged at opposite sides of the path, and a support member 143 disposed under the path of travel of the chain.

The upper ear pressing member 141 is fixed to the lower end of a vertically movable rod 145 inserted through a vertical guide sleeve 144 on the mount frame 35. The rod 145 has an upper end connected by a rod 146 to one end of a lever 147. The other end of the lever 147 has connected thereto the upper end of a vertical retractable rod 148 extending from the drive mechanism 18.

The lower ear pressing members 142 are attached to the lower ends of a pair of right and left levers 152 mounted on a bracket 151 depending from the mount frame 35. The upper ends of the levers 152 are connected by a pair of links 153 to respective opposite ends of en arm 154, which is fixed to an intermediate portion of height of the movable rod 145.

The support member 143 is in the form of a horizontal bar extending in the direction of travel of the chain, and has a length slightly smaller than the combined length of two transport blocks 71 so as to be coextensive with two adjacent blocks 71. The support member 143 is upwardly and downwardly movably held at its front and rear sides and right and left sides by a guide member 161 provided on the left guide rail 76. A lift arm 163 has a forward end connected by a link 162 to the midportion of length of the support member 143, and a base portion fixed to the left end of a horizontal pivot 164 laterally extending through the inner wall of the right side frame 25. The right end of the pivot 164 has fixed thereto the bass portion of an actuating arm 165, which has a forward end connected to the piston rod of a fluid pressure cylinder 166 attached to the inside surface of the frame inner wall. The radius of rotation (pivotal movement) of the actuating arm 165 is approximately three times the radius of rotation (pivotal movement) of the lift arm 163.

The upper ears and lower ears of the container are heated by the heating device 28 immediately before the container is fed to the ear bonding device 29. (The nozzles 125, 134 of the upper and lower heaters are indicated in dot-and-dash lines in FIG. 11.) When the container is brought to the location of the ear bonding device 29, the retractable rod 145 operates, lowering the movable rod 145. The upper ear pressing member 141 is lowered with the rod 145 to press the portion of the container to be made into the bottom thereof, while the arm 154 lowered with the movable rod 143 moves the upper ends of the two levers 152 away from each other, thereby moving the lower ear pressing members 142 toward each other to press the portions to be made into opposite side walls of the container against each other. Consequently, the upper ears are bonded by the upper ear pressing member 141 under pressure to the portion providing the bottom of the container, and the lower ears are bonded by the respective lower pressing members 142 under pressure to the respective portions providing the side walls of the container.

Prior to the operation of the pressing member 141 and the pressing member 142, the fluid pressure cylinder 166 operates, rotating the actuating arm 165, pivot 164 and lift arm 163 counterclockwise in FIG. 11, whereby the forward end of the lift arm 163 is pushed up, causing the link 162 to push up the support member 143 into pressing contact with the lower surface of the chain 63. As a result, the adjacent two holders 64 then positioned above the member 143 are pushed up along with the chain 63, and the rollers 76 of the pushed portion of the chain 63 are pressed against the upper walls of the guide rails 76 defining the respective guide grooves 77. When the pressing members 141, 142 are operated in this state, the pressure of these members 141, 142 is exerted on the adjacent holders 64 and received by the support member 143 through the chain 64.

If the pressure acts on the holders 64 in the absence of the support member 143, the two adjacent transport blocks 71 concerned will flex and incline relative to each other by an amount corresponding to the play of the chain rollers 75 between the upper and lower walls defining the guide grooves 77 or to a clearance involved in each groove 77, possibly permitting the two adjacent holders 64 to flex relative to each other so that the space between the side walls 82 of these holders 64 would enlarge from portion to portion upward. It would then be impossible to subject the container supported by the adjacent holders 64 to a suitable pressure to create a faulty ear seal. However, the presence of the support member 143 obviates the likelihood of the adjacent holder 64 flexing and faulty sealing.

Referring to FIG. 2 again, the container discharge device 30 comprises a large drive sprocket 171 and a small driven sprocket 172 which are disposed at one side of the terminal end of the container transport path, an endless chain 173 reeved around these two sprockets 171, 172, and a pusher pin 174 attached to the chain 173 so as to advance into the container transport path on the transport side of the path for the chain.

Similarly with reference to FIG. 2, the drive mechanism 18 comprises a drive shaft 181 extending longitudinally of the machine and coupled at its rear end to the main shaft 17 by a belt, a main transmission shaft 183 having a rear end connected to the front end of the drive shaft 181 via a main clutch 182, and a drive motor 185 connected to the main transmission shaft 183 via a secondary clutch 184.

The drive shaft 181 has a reduction gear unit 191 incorporated therein. The main clutch 182 is a one-way clutch adapted for one-position engagement to transmit counterclockwise torque therethrough but not to permit transmission of clockwise torque as the clutch is seen from rear. The main transmission shaft 183 has fixed thereto a cam 192 for operating the ear folding device, a cam 193 for operating the ear bonding device and a gear 194 for driving the conveyors, as arranged from the rear forward. The retractable rod 111 is coupled to the cam 192, and the retractable rod 148 to the cam 193. The secondary clutch 184 is a one-way clutch adapted for multi-position engagement to transmit clockwise torque therethrough but not to permit transmission of counterclockwise torque as the clutch is seen from rear.

The conveyor drive gear 194 is in mesh with a driven gear 197 fixed to an input shaft 196 of an index body 195. The index box 195 has a main output shaft 198 projecting rightward and coupled to the drive sprocket 61 of the conveyor 14, and a secondary output shaft 199 projecting forward. A secondary transmission shaft 203 is coupled to the secondary output shaft 199 by means of a pair of bevel gears 201, 202 mashing with each other. A manual handle 204 is removably attached to one end of the shaft 203. The shaft 203 is coupled to the drive sprocket 171 of the container discharge device 30 by a chain.

During the steady-state packaging operation, the drive shaft 181 is driven by the main shaft 17 counterclockwise as it is seen from behind, with the handle 204 removed from the secondary transmission shaft 203. The rotation of the drive shaft 181 is transmitted to the main transmission shaft 183 by the main clutch 182, whereas the rotation of the shaft 183 is not delivered to the motor 185 by the secondary clutch 184. The first device group 13 is driven by the main shaft 17, and the conveyors 14 and the second device groups 15 are driven by the main transmission shaft 183. When the conveyor 14 is driven, the drive sprocket 61 is rotated clockwise, and the secondary transmission shaft 203 is rotated counterclockwise as indicated by respective arrows in FIG. 2.

When the packaging operation is to be terminated, the main shaft 17 is brought to a halt, whereby the first device group 13, conveyors 14 and second device groups 15 are all brought out of operation. When containers C are no longer delivered from the first device group 13 onto the conveyors 14 with the first device group 13 brought out of operation, the containers C sent to each conveyor 14 immediately before the cessation of operation remain on the conveyor 14. Accordingly, the containers C need to be delivered from the conveyor 14. For this purpose, the motor 185 is operated to rotate the output shaft thereof counterclockwise as it is seen from behind. Whereupon the rotation of the output shaft is delivered to the main transmission shaft 183, but the transmission of rotation of the shaft 183 to the main shaft 17 is interrupted by the main clutch 182. The rotation of the main transmission shaft 183 holds the conveyor 14 and the second device group 15 driven until all the containers C on the conveyor 14 are discharged.

When the size of containers is to be changed, the attachments 65 need to be mounted on the holders 64 or removed therefrom. In this case, the manual handle 204 is attached to the secondary transmission shaft 203 and then turned counterclockwise in FIG. 2. This drives the drive sprocket 61 clockwise in FIG. 2. The operator mounts or removes the attachment 65 on or front the approaching holder 64 with one hand while moving the handle 204 with the other hand. When the handle 204 is rotated, the main transmission shaft 183 is rotated counterclockwise as it is seen from behind, whereas the transmission of rotation of the shaft 183 to the main shaft 17 is interrupted by the main clutch 182, while the second clutch 184 interrupts the transmission of rotation to the motor 185 in this case.

With reference to FIG. 2 and FIGS. 12 to 14, the transfer device 16 comprises a slanting chute 211 generally U-shaped in cross section, attached to the main frame 11 in the vicinity of the incomplete container forming device 24 and extending from the container discharge position of the device 24 toward the space between the starting ends of container transport paths of the two container conveyors 14; a slide plate 212 disposed between the path starting ends, connected to the lower edge of bottom wall of the chute 211 and inclined at the same angle as the chute 211; a horizontal stopper plate 213 integral with the lower edge of the slide plate 212; a plurality of container receiving members 214 so arranged as to move upward and downward along the chute 211; and a container pushing member 215 reciprocatingly movable horizontally along the slide plate 212 thereabove.

The chute 211 has a length corresponding to approximate combined length of three incomplete containers C, a width slightly larger than the width of the incomplete container C and a depth slightly smaller than the thickness of the incomplete container C.

The slide plate 212 has such a length transversely of the conveyors 14 as to extend approximately over the entire space between the holder 64 on one of the conveyors 14 and the holder on the other conveyor 14, and a height approximately equal to that of one container C. The plate 212 is attached to and extends between the forward ends of opposite side plates of a top frame 216 U-shaped in vertical section and extending over the top walls of the two front frames 12. A horizontal slit 217 is formed in an intermediate portion of height of the slide plate 212 to divide the plate 212 into upper and lower two portions.

The container receiving members 214 are attached as arranged at equal intervals to a pair of endless chains 221 extending in parallel to each other for driving these members 214. Each chain 221 extends from a position close to the upper end of the chute 211 to a position close to the lower end of the slide plate 212, is inclined at the same angle with the chute 211 and is so disposed as to cause the receiving member 214 to advance into the chute 221 from the chain 221 in the lower path of travel thereof. The lower end of the chain 221 is reeved around a drive sprocket 223 fixed to a chain drive shaft 222. A driven sprocket 224 for driving the drive shaft 222 is fixed to this shaft 222. The upper end of the chain 221 is reeved around a driven sprocket 226 fixed to a driven shaft 225 for driving the chain (FIG. 2).

A center plate 231 and a pair of right and left side plates 232 are opposed to the slide plate 212 as spaced therefrom by a distance corresponding to the thickness of the container C. The center plate 231 is in the form of a strip and extends between the pair of chains 221 longitudinally thereof. The side plates 232 are each in the form of a rectangular plate and arranged at the right and left sides of the pair of chains 221. On one side of the path of travel of holders on each conveyor 14 opposite to the side plate 232, there is disposed a vertical plate 233 for preventing the container from falling down.

The container pushing member 215 is generally H-shaped when seen in a plan view and attached to a slider 242 by a connecting member 241 inserted through the slit 217. The slider 242 is fitted to a guide rail 243 opposed to and extending in parallel to the slide 217, and has a guide groove 244 orthogonal to the guide rail 243. The guide rail 243 is connected between the opposite side plates of the top frame 216.

An endless chain 245 for driving the container pushing member 215 is provided between the bottom plate of the top frame 216 and the guide rail 243. Attached to the chain 245 is a pushing pin 246 fitted in the guide groove 244. The chain 245 is reeved at its right end around a drive sprocket 247 and at its left end around a driven sprocket 248. A driven sprocket 249 is fixed to the drive sprocket 247 concentrically therewith and is in mesh with a drive gear 250, which in turn is fixed to an output shaft 252 of a secondary gear box 251.

With reference to FIG. 2, a main gear box 253 is disposed at a position obliquely forwardly downward of the secondary gear box 251. The main gear box 253 has a forwardly projecting input shaft 254, and a leftwardly projecting output shaft 255. The input shaft 254 is driven by the main transmission shaft 183 in synchronism therewith by way of an unillustrated transmission mechanism. A drive sprocket 256 for driving the drive shaft 222 is secured to the output shaft 255. The driven sprocket 224 and the drive sprocket 256 have reeved therearound an endless chain 258 passed around idle sprockets 257. A connecting pipe 259 extends from the secondary gear box 251 to the main gear box 253. An unillustrated intermediate shaft inserted through the pipe 259 drives the two gear boxes 251, 253 in synchronism.

Power is transmitted from the main transmission shaft 183 to the input shaft 254 of the main gear box 253 to drive the output shaft 255. The drive force is transmitted to the drive shaft 222, moving the endless chains 221 for driving the container receiving members 214 counterclockwise in FIG. 2. Consequently, the members 214 are lowered on the lower paths of travel of the chains, and are moved upward on the upper paths of travel of the chains. The speed of travel of the container receiving member 214 is made lower than the velocity at which the container C falls along the chute 211 under gravity.

When the secondary gear box 251 is driven on the other hand, the endless chain 245 for driving the container pushing member 215 is driven. With the movement of the chain 245, the pushing in 246 moves as fitted in the guide groove 244. On the upper or lower path of travel of the chain 245, the pushing pin 246 moves straight rightward or leftward, moving the slider 242 along the guide rail 243. On one turn path from the upper path to the lower path, or on the other reverse turn path, the pin 246 pushes the slider 242 while moving upward or downward within the guide groove 244, and the direction of travel of the slider 242 is reversed in the meantime. The container pushing member 215 is moved with the slider 242.

The container receiving members 214 are timed with the container pushing member 215 so that every time the receiving members 214 are moved a distance corresponding to the pitch thereof, the pushing member 215 is moved rightward or leftward by one stroke length of its reciprocating travel.

The container C is allowed to fall off the incomplete container forming device 24 into the chute 211 and received by the uppermost receiving members during descent. It is desired that the position at which the container is received by the members 214 be as high as possible within the chute 211. The distance the container C falls spontaneously can then be small, and the container C will not be damaged when received. With the travel of the receiving members 214, the container C is lowered while sliding on the bottom wall of the chute 211. Upon the members 214 receiving the container C reaching the lower end of the path of travel of the chains, the container so far received by the members 214 are transferred from the chute 211 onto the slide plate 212 and received by the stopper plate 213. The center plate 231 which holds the container at this time eliminates the likelihood that the container C will jump owing to the impact of reception. The pushing member 215 moves along to push the container C as received by the stopper plate 213. The container C as received by the stopper plate 213 and held between the slide plate 213 and the side plate 232 is pushed rightward or leftward while sliding on the slide plate 213. Now, suppose the container C is pushed rightward. When the container C has been pushed to the right end of the slide plate 213, the container C is discharged rightward from the slide plate 213 and received in the space between a pair of adjacent holders 64 on the right conveyor 14.

When the following container C is received by the stopper plate 213, the container C is pushed leftward this time on the slide plate 213 by the pushing member 215 moved leftward and then discharged from the left end of the slide plate 213 to the space between a pair of adjacent holders 64 on the left conveyor 14. The operation described above is repeated in succession, whereby the containers C discharged from the incomplete container forming device 24 in a row are dividedly deliverd to the right and left conveyors 14 alternately.

What is claimed is:

1. A packaging machine comprising an incomplete container forming device for forming a web into a tube, filling contents into the tube, thereafter transporting the tube by a length corresponding to one container at a time, sealing and cutting the tube transversely of the tube every time the tube is transported to obtain flat tubular incomplete containers, and discharging the containers as arranged in a row; a pair of container conveyors arranged at a lower level than the discharging position of the device, horizontally spaced from the discharging position by a specified distance and having respective transport paths spaced from each other by a predetermined distance; a complete container forming device for making the incomplete containers into complete rectangular parallelepipedal containers during transport on the conveyors; and a transfer device for receiving the row of incomplete containers as discharged from the incomplete container forming device, dividing the row into two rows and delivering the two rows alternately to the respective container conveyors.

2. A packaging machine as defined in claim 1 wherein the transfer device comprises a slanting chute generally U-shaped in cross section and extending from the discharging position toward a space between starting ends of the transport paths of the conveyors, a dividing plate disposed between the starting ends of the transport paths and continuous with a lower edge of bottom wall of the chute for receiving each container to restrain the container from descending while rendering the container free to move horizontally, a container receiving member so disposed as to move upward and downward along the chute and to advance into the chute when moving downward, and a container pushing member reciprocatingly movable on the dividing plate in directions orthogonal to a path of upward and downward movement of the container receiving member.

3. A packaging machine as defined in claim 2 wherein the container receiving member is moved downward at a speed lower than the velocity at which the container falls down the chute under gravity.

4. A packaging machine as defined in claim 2 or 3 wherein the container receiving member is attached to an endless chain having a lower path of travel positioned within the chute so that the receiving member is advanced into the chute from the chain on the lower path.

5. A packaging machine as defined in claim 2 wherein the dividing plate is formed with a slit extending in parallel to a path of reciprocating movement of the container pushing member, and a guide rail extending in parallel to the slit and an endless chain are arranged at one side of the dividing plate opposite to the path of reciprocating movement, the endless chain having a reciprocating moving straight path parallel to the guide rail, a slider being fitted to the guide rail and formed with a guide groove extending in a direction orthogonal to the guide rail, a pushing pin being attached to the chain and fitted in the guide rail, the container pushing member being attached to the slider by a connecting member inserted through the slit.

* * * * *